US009777685B2

(12) United States Patent
Maragliulo

(10) Patent No.: US 9,777,685 B2
(45) Date of Patent: Oct. 3, 2017

(54) ELECTROMAGNETIC ACTUATOR ASSEMBLY FOR A FLUID INJECTION VALVE AND METHOD FOR OPERATING A FLUID INJECTION VALVE

(71) Applicant: Continental Automotive GmbH, Hannover (DE)

(72) Inventor: Marco Maragliulo, San Miniato (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 34 days.

(21) Appl. No.: 14/653,375

(22) PCT Filed: Nov. 11, 2013

(86) PCT No.: PCT/EP2013/073508
§ 371 (c)(1),
(2) Date: Jun. 18, 2015

(87) PCT Pub. No.: WO2014/095161
PCT Pub. Date: Jun. 26, 2014

(65) Prior Publication Data

US 2015/0345444 A1 Dec. 3, 2015

(30) Foreign Application Priority Data

Dec. 21, 2012 (EP) ..... 12198883

(51) Int. Cl.
*F02M 51/06* (2006.01)
*H01F 7/18* (2006.01)
*F02D 41/20* (2006.01)

(52) U.S. Cl.
CPC ..... *F02M 51/0614* (2013.01); *F02D 41/20* (2013.01); *F02M 51/0621* (2013.01);
(Continued)

(58) Field of Classification Search
CPC ..... F02M 51/0614; F02M 51/0621; F02M 51/0671; F02D 41/20; F02D 2041/2079; H01F 7/1827; H01F 7/1833
See application file for complete search history.

(56) References Cited

U.S. PATENT DOCUMENTS 3,643,129 A * 2/1972 Marsh ..... H02H 9/005 307/104
3,665,901 A * 5/1972 Monpetit ..... F02D 41/20 123/490

(Continued)

FOREIGN PATENT DOCUMENTS

CN 101025137 A 8/2007 ..... F02M 51/06
DE 102006000223 A1 11/2006 ..... F02D 41/20

(Continued)

OTHER PUBLICATIONS

European Search Report, Application No. 12198883.6, 5 pages, May 3, 2013.

(Continued)

*Primary Examiner* — Joseph Dallo
(74) *Attorney, Agent, or Firm* — Slayden Grubert Beard PLLC

(57) ABSTRACT

An electromagnetic actuator assembly for a fluid injection valve includes a first coil and a second coil, which are configured for moving an armature, and an electrical connection circuit for connecting the first and second coils to a power supply. The electrical connection circuit is configured to energize the first coil without energizing the second coil in a first operating mode of the actuator assembly and to energize both the first coil and the second coil in a second operating mode of the actuator assembly.

10 Claims, 2 Drawing Sheets

(52) U.S. Cl.
CPC ..... *F02M 51/0671* (2013.01); *H01F 7/1827* (2013.01); *H01F 7/1833* (2013.01); *F02D 2041/2079* (2013.01)

(56) References Cited

U.S. PATENT DOCUMENTS

| | | | | | |
|---|---|---|---|---|---|
| 3,743,898 | A * | 7/1973 | Sturman | F02D 41/20 | 335/254 |
| 4,355,619 | A * | 10/1982 | Wilkinson | F02D 41/20 | 123/478 |
| 4,688,138 | A * | 8/1987 | Nagata | F02D 41/20 | 123/490 |
| 5,141,164 | A * | 8/1992 | Ohno | F02M 51/0685 | 239/585.2 |
| 5,644,280 | A * | 7/1997 | Wilson | H01F 7/18 | 251/129.1 |
| 5,992,391 | A | 11/1999 | Yamakado et al. | 123/490 | |
| 5,995,356 | A * | 11/1999 | Glavmo | F02D 41/20 | 361/154 |
| 6,005,763 | A * | 12/1999 | North | F02D 41/20 | 123/490 |
| 6,113,014 | A * | 9/2000 | Coldren | F02D 41/20 | 239/585.1 |
| 6,634,338 | B1 * | 10/2003 | Yamakado | F02D 41/20 | 123/490 |
| 6,919,651 | B2 * | 7/2005 | Bolz | H03K 17/08142 | 307/104 |
| 7,095,599 | B2 | 8/2006 | Maekawa et al. | 361/152 | |
| 7,549,438 | B2 * | 6/2009 | Koenekamp | F16K 49/002 | 137/341 |
| 7,819,344 | B2 | 10/2010 | Abe et al. | 239/585.2 | |
| 2002/0166541 | A1 | 11/2002 | Yamakado et al. | 123/490 | |
| 2003/0019948 | A1 * | 1/2003 | Shinogle | F02D 41/20 | 239/90 |
| 2003/0116657 | A1 | 6/2003 | Nakayama et al. | 239/585.1 | |
| 2004/0108395 | A1 | 6/2004 | Hamada et al. | 239/585.1 | |
| 2005/0073795 | A1 * | 4/2005 | Maekawa | F02D 41/20 | 361/160 |
| 2012/0104112 | A1 * | 5/2012 | Grandi | F02D 41/20 | 239/11 |
| 2014/0292092 | A1 * | 10/2014 | Ichinose | H02J 5/005 | 307/104 |
| 2015/0345444 | A1 * | 12/2015 | Maragliulo | F02D 41/20 | 239/5 |

FOREIGN PATENT DOCUMENTS

| | | | | | |
|---|---|---|---|---|---|
| DE | 102011080858 | | * | 2/2013 | |
| DE | 202012009805 | | * | 2/2014 | |
| DE | 102012113056 | | * | 6/2014 | |
| EP | 1281854 | A2 | * | 2/2003 | F02D 41/20 |
| EP | 1522699 | A2 | | 4/2005 | F02D 41/20 |
| EP | 1522699 | A3 | | 4/2006 | F02D 41/20 |
| EP | 2221468 | A1 | | 8/2010 | F02M 51/06 |
| EP | 2428672 | A2 | | 3/2012 | F02M 51/06 |
| EP | 2282043 | B1 | | 4/2013 | F02D 41/20 |
| JP | 59224464 | A | | 12/1984 | F02M 51/06 |
| JP | 2012202279 | A | | 10/2012 | F02M 51/06 |
| JP | 2013252018 | A | * | 12/2013 | |
| JP | 2014007942 | A | * | 1/2014 | |
| WO | 2011/000663 | A1 | | 1/2011 | F02D 41/20 |
| WO | 2014/095161 | A1 | | 6/2014 | F02D 41/20 |

OTHER PUBLICATIONS

International Search Report and Written Opinion, Application No. PCT/EP2013/073508, 9 pages, Jan. 7, 2014.

Chinese Office Action, Application No. 201380062583.4, 13 pages, Nov. 28, 2016.

* cited by examiner

ELECTROMAGNETIC ACTUATOR ASSEMBLY FOR A FLUID INJECTION VALVE AND METHOD FOR OPERATING A FLUID INJECTION VALVE

CROSS-REFERENCE TO RELATED APPLICATIONS

This application is a U.S. National Stage Application of International Application No. PCT/EP2013/073508 filed Nov. 11, 2013, which designates the United States of America, and claims priority to EP Application No. 12198883.6 filed Dec. 21, 2012, the contents of which are hereby incorporated by reference in their entirety.

TECHNICAL FIELD

The present disclosure relates to an electromagnetic actuator assembly for a fluid injection valve, to a fluid injection valve with the actuator assembly, and to a method for operating the fluid injection valve.

BACKGROUND

A fluid injection valve is disclosed, for example, in EP 2221468 A1. The fluid injection valve has an electromagnetic circuit for moving a valve needle. The valve needle is mechanically coupled to an armature of the electromagnetic circuit, so that the armature moves the valve needle against the mechanical force of a spring and against hydraulic forces of the fluid when a coil of the electromagnetic circuit is activated to move the armature. The spring is provided for keeping the injection valve closed when the electromagnetic circuit is inactivated. The armature moves the valve needle away from the closing position.

The hydraulic forces are pressure dependent. Therefore, in order to operate at high fuel pressures, a coil with a high inductance is needed for opening the injection valve. However, due to the high inductance, the coil has a slow response when it is deactivated, so that the minimum flow during one dispense operation of the fuel injection valve is comparatively high.

If, on the other hand, a coil with a lower inductance is selected, the injection valve has a lower maximum working pressure, leading to a reduced maximum flow during one dispense operation.

WO 2011/000663 A1 discloses a fluid injector with a solenoid assembly which comprises a first and a second coil and which is operable to magnetically actuate the armature via an electrical signal applied to at least one predetermined assortment of the two coils.

SUMMARY

One embodiment provides an electromagnetic actuator assembly for a fluid injection valve comprising: a first coil and a second coil, the first and second coils being configured for moving an armature, an electrical connection circuit for connecting the first and second coils to a power supply, and a first external electrical connection and a second external electrical connection, the first and second external electrical connections being configured for connecting the electrical connection circuit to the power supply, wherein the electrical connection circuit is configured to energize the first coil without energizing the second coil in a first operating mode of the actuator assembly and to energize both the first coil and the second coil in a second operating mode of the actuator assembly, and wherein the actuator assembly is configured to be in the first operating mode when a direct current flows from the first to the second external electrical connection and to be in the second operating mode when a direct current flows from the second to the first external electrical connection.

In a further embodiment, the electrical connection circuit comprises a switching component, the switching component is configured for reducing a current flow through the second coil or for short-circuiting the second coil when the actuator assembly is in the first operating mode.

In a further embodiment, the switching component comprises a diode.

In a further embodiment, either (a) the first coil and the second coil are electrically connected in series by means of the electrical connection circuit and the switching component is electrically connected in parallel to the second coil or (b) the second coil and the switching component are electrically connected in series and, together, are electrically connected in parallel to the first coil.

In a further embodiment, the armature and a valve needle, the valve needle being mechanically coupled to the armature, so that the electromagnetic actuator assembly is operable to move the valve needle by means of magnetic interaction with the armature.

Another embodiment provides a method for operating the fluid injection valve disclosed herein, comprising the following steps: determining a property of the fluid to be dispensed by the fluid injection valve, comparing the determined fluid property with a predetermined threshold, and subsequently feeding an operating current to the electrical connection circuit via the first and second external electrical connections for operating the electromagnetic actuator assembly in order to dispense the fluid from the fluid injection valve, wherein when the determined fluid property is smaller than the predetermined threshold, the fluid injection valve is operated in the first operating mode by means of feeding the operating current to the electrical connection circuit via the first and second external electrical connections in such way that the operating current flows from the first to the second external electrical connection and, wherein when the determined fluid property is larger than the predetermined threshold, the fluid injection valve is operated in the second operating mode by means of feeding an operating current to the electrical connection circuit via the first and second external electrical connections in such way that the operating current flows from the second to the first external electrical connection.

In a further embodiment of the method, the determined fluid property is a fluid quantity to be dispensed by the fluid injection valve or a fluid pressure.

BRIEF DESCRIPTION OF THE DRAWINGS

Example embodiments are described in greater detail below with reference to the drawings, in which.

DETAILED DESCRIPTION

Figure 1:
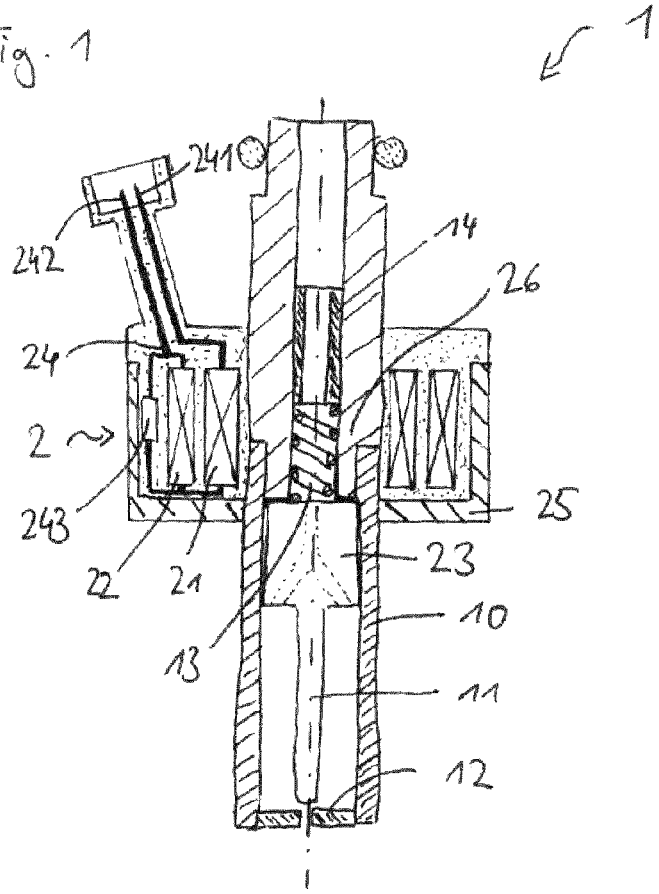
FIG. 1 shows a schematic cross section through an injection valve with an electromagnetic actuator assembly according a first embodiment.

Embodiments of the present disclosure provide an improved fluid injection valve, in particular having a particularly large working flow range and/or being easily controllable.

This object is achieved by an electromagnetic actuator assembly for a fluid injection valve and by a method for operating a fluid injection valve.

Some embodiments provide an electromagnetic actuator assembly for a fluid injection valve, which actuator assembly comprises a first coil and a second coil. The first and second coils are configured for moving an armature—in particular by means of electromagnetic interaction with the armature. The actuator assembly further comprises an electrical connection circuit. The electrical connection circuit is in particular provided for connecting the first and second coils to a power supply, such as an engine control unit. The electrical connection circuit is configured to energize the first coil without energizing the second coil in a first operating mode of the actuator assembly and to energize both the first coil and the second coil in a second operating mode of the actuator assembly.

That the actuator assembly works "without energizing the second coil" in the first operating mode means in particular that the magnitude of the current flowing through the second coil in the first operating mode is 50% or less, preferably 10% or less, in particular 2% or less as compared to the magnitude of the current flowing through the second coil in the second operating mode when the actuator assembly is operated under such conditions that the current through the first coil has basically the same magnitude in the first and second operating modes.

The electromagnetic actuator assembly may be comprised by a fluid injection valve, in particular by a fuel injection valve. The fluid injection valve may be comprised by an internal combustion engine.

The fluid injection valve expediently comprises the armature. It may further comprise a valve needle. The valve needle and the armature are, for example, arranged in a valve body of the fluid injection valve. Expediently, the armature may be mechanically coupled to the valve needle in such fashion that it is operable to move the valve needle when the electromagnetic actuator assembly is operated. In particular, the armature is operable to move the valve needle away from a closing position in which closing position the valve needle preferably prevents the fluid injection valve from dispensing fluid.

The first and second coils and the armature are in particular comprised by a magnetic circuit. The magnetic circuit may also comprise additional parts of the fuel injection valve, for example a pole piece, a yoke and/or the valve body.

With advantage, a particularly large working flow range is achievable with the electromagnetic actuator assembly. In the first operating mode, basically only the inductance of the first coil is relevant, so that the actuator assembly may respond particularly fast when an operating current is switched on or off. A particularly small minimum fluid flow is therefore achievable. However, the actuator assembly is also operable to generate a particularly large magnetic force on the armature by means of the first and second coils being simultaneously operated when the actuator assembly is operated in the second operating mode. Therefore, the fluid injection valve is operable to open at particularly high fluid pressures. In other words, it has a particularly high maximum working pressure and, thus, a particularly large maximum fluid flow is achievable per injection event.

In one embodiment, the first and the second coil are arranged concentrically, in particular around the valve body and/or around the pole piece. In an alternative embodiment, the first and second coils may also be arranged subsequently in a direction along a longitudinal axis of the actuator assembly or the valve body.

According to one embodiment, the electrical connection circuit comprises a switching component. Expediently, the switching component is configured for reducing a current flow through the second coil or for short-circuiting the second coil and when the actuator assembly is in the first operating mode.

In one embodiment, the first coil and the second coil are electrically connected in series by means of the electrical connection circuit and the switching component is electrically connected in parallel to the second coil. In another development, the second coil and the switching element are connected in series and the series connection of the second coil and the switching element is connected in parallel to the first coil.

In some embodiments, the switching component may comprise at least one of a relay, a switch or a transistor. In a preferred embodiment, the switching device comprises a diode or consists of a diode. With a switching device comprising a diode, switching between the first and second operating modes is particularly simple and manufacturing the electrical connection circuit is particularly cost effective.

The electrical connection circuit has a first external electrical connection and a second external electrical connection. The first and second external electrical connections are in particular configured for electrically connecting the electrical connection circuit to the power supply. For example, the first external electrical connection and the second external electrical connection each comprise an electrical terminal which may be arranged in a connector bay of the fluid injection valve. Preferably, the actuator assembly is designed in such fashion that an operating current for the first and second coils can be provided to the electrical connection circuit via the first and second external electrical connections. The operating current may be generated by the power supply.

In one embodiment, the actuator assembly is configured to be in the first operating mode when a direct current flows from the first to the second external electrical connection and to be in the second operating mode when a direct current flows from the second to the first external electrical connection. The current flow direction is in particular the direction of conventional current (i.e. of positive charges) in these cases. For example, the electrical resistance of the switching device may be dependent on the current direction, e.g. when the switching device comprises or consists of a diode. The power supply may be expediently configured in such fashion that it is operable to provide a first operating current to the electrical connection circuit which flows in the direction from the first to the second external electrical connection and to provide a second operating current to the electrical connection circuit which flows in the direction from the second to the first external electrical connection. In this way, the actuator assembly is easily switch-able between the first and second operating modes, in particular by reverting the current direction supplied to the electrical connection circuit.

Other embodiments provide a method for operating the disclosed fluid injection valve.

According to one step of the method, a property of the fluid which is to be dispensed by the fluid injection valve—in particular during one injection event—is determined.

According to a further, e.g., subsequent, method step, the determined fluid property is compared with a predetermined threshold. In an expedient development, the operation mode of the actuator assembly is selected in dependence on the comparison result.

According to a subsequent method step, the fluid injection valve is operated for dispensing the fluid. When the determined fluid property is smaller than the predetermined threshold, the fluid injection valve is operated in the first operating mode. When the determined fluid property is larger than the predetermined threshold, the fluid injection valve is operated in the second operating mode.

Expediently, an operating current for the actuator assembly is fed into the electrical connection circuit via the first and second external electrical connections in such way that the operating current flows from the first to the second external electrical connection when the determined fluid property is smaller than the predetermined threshold and in such way that the operating current flows from the second to the first external electrical connection when the determined fluid property is larger than the predetermined threshold.

In one embodiment, the fluid property is the fluid quantity which is to be dispensed by the fluid injection valve. The fluid quantity to be dispensed by the fluid injection valve is for example provided for one injection event of the at least one injection events during a cylinder stroke of the internal combustion engine.

The inventor has found that pressure fluctuations of the fluid to be injected by the fluid injection valve have a larger amplitude—for example in the range of 30% of the nominal pressure—when large doses of fluid are dispensed, for example during an engine failure mode, such as a so-called "limp home mode". The amplitude of the pressure fluctuations is lower when the fluid injection valve is operated to dispense small doses. With advantage, when only small fluid doses are dispensed, the fluid injection valve does not need to be operated with a coil having an inductance which is sufficient to operate when large amplitude fluctuations occur.

In another embodiment of the method, the fluid property is a fluid pressure of the fluid to be injected by the fluid injection valve. In one development, the fluid injection valve may be operated in the first operating mode when the determined fluid pressure is between 10% and 90% of a nominal maximum working pressure which is specified for the fluid injection valve.

In an embodiment of the method, an engine control unit is provided for determining the fluid quantity which is to be dispensed, comparing the determined fluid quantity with the predetermined threshold and selecting the first or second operating mode, respectively, for the fluid injection valve depending on the result of the comparison between the determined fluid quantity and the predetermined threshold.

FIG. 1 shows a schematic cross section through a fluid injection valve 1 according to a first embodiment. The fluid injection valve 1 may be comprised by a combustion engine, preferably by a direct injection engine such as a direct injection spark ignition engine. Preferably, the fluid injection valve 1 is a fuel injection valve. It may be received in a cylinder head of the combustion engine.

The fluid injection valve 1 has a valve body 10, an armature 23, a valve needle 11 and a valve seat 12. The valve body 10 has a longitudinal axis. The valve needle 11 is axially movable in an interior of the valve body 10. In a closing position, the valve needle 11 abuts the valve seat 12 such that it closes an injection nozzle, the injection nozzle being provided in the valve seat 12, to prevent fluid from being dispensed by the injection valve through the nozzle.

The armature 23 may comprise or consist of steel, in particular a ferromagnetic steel. The armature 23 may comprise a fluid passage (indicated by the dashed lines in FIG. 1).

In the present embodiment, the armature 23 is formed as a one-piece element with the valve needle 11. Alternatively, the armature 23 may be arranged axially movable with respect to the valve needle 11. In this case, the valve needle 11 may, for example, extend axially through an opening of the armature 23 and have a stop member which is operable to limit the axial movement of the armature 23 with respect to the valve needle 11 in an axial direction away from the closing position of the valve needle 11. In this way, the armature 23 is mechanically coupled to the valve needle 11 so that the armature 23 is operable to move the valve needle 11 away from its closing position for dispensing fluid.

The fluid injection valve 1 further comprises an electromagnetic actuator assembly 2. The actuator assembly 2 comprises a first coil 21 and a second coil 22. The actuator assembly 2 also comprises an electrical connection circuit 24. Further, the actuator assembly 2 in the present embodiment comprises a yoke 25 and a pole piece 26, which are in particular positionally fix with respect to each other. The yoke 25 may represent a housing for the first and second coils 21, 22. In axial direction, the armature 23 is arranged between the valve seat 12 and the pole piece 26. It is spaced apart from the pole piece 26 when the valve needle 11 is in the closing position.

The pole piece 26 may expediently have an axial opening which extends the interior of the valve body 10 towards a fluid inlet end of the injection valve 1, the fluid inlet end being opposite of the valve seat 12. The fluid inlet end may be provided with a sealing element for coupling to a fluid rail, for example. In the present embodiment, the fluid inlet end is hydraulically coupled to the interior of the valve body 10 via the axial opening of the pole piece 26 and the fluid passage of the armature 23. In another embodiment, the valve needle 11 is hollow and the fluid flows from the fluid inlet opening through the axial opening of the pole piece 26 and further through the valve needle 11 to the interior of the valve body 10 to the injection nozzle in the valve seat 12.

The first coil 21, the second coil 22, the armature 23, the yoke 25 and the pole piece 26 are arranged to form a magnetic circuit. The actuator assembly 2 is arranged in such fashion that, by means of the magnetic circuit, a magnetic force is exerted on the armature 23 in the direction towards the pole piece 26 when an operating current flows through the first coil 21 or through the first and second coils 21, 22.

The fluid injection valve 1 further has a spring 13 which is operable to bias the armature 23 and the needle 11 in a direction away from the pole piece 26, in particular towards the valve seat 12. In the present embodiment, the spring abuts the armature 23, so that the armature 23 the armature 23 transfers a force to the valve needle 11 to press the latter against the valve seat 12. The spring 13 is in particular operable to hold the valve needle 11 in the closing position when the actuator assembly 2 is inactive.

An end of the spring 13 which is remote from the armature 23 may be seated against a calibration tube 14. During assembly of the fluid injection valve 1, the spring load may be adjustable by axially moving the calibration tube 14. The calibration tube 14 may be arranged in the axial opening of the pole piece 26, for example. In one development, the calibration tube 14 comprises a fuel filter (not shown in the figures).

The actuator assembly 2 is configured in such fashion—for example by means of selecting the number of spires of the first coil 21 and of the second coil 22—that the magnetic force on the armature 23 exceeds the spring load of the spring 13 when at least the first coil 21 of the actuator assembly 2 is operated. The first coil 21 and the second coil 22 are arranged in such fashion, that the magnetic force on the armature 23 increases when the second coil 22 is operated in addition to the first coil 21. The amount by which the magnetic force exceeds the spring force determines the hydraulic forces which can be overcome by the actuator assembly and, thus, the maximum fluid pressure at which the fluid injection valve 11 can operate.

In the present embodiment, for example, the first and the second coils 21, 22 are arranged concentrically around the valve body 10 and the pole piece 26. Preferably, the spires of the first and second coils 21, 22 are wound in the same direction. The first and second coils 21, 22 may alternatively also be arranged subsequently in axial direction.

Due to this configuration of the actuator assembly 2, it is operable to move the armature 23 towards the pole piece 26 against the bias of the spring 13 by means of electromagnetic interaction with the armature 23. The armature 23, in turn, moves the valve needle 11 by means of mechanical interaction, as described above.

By means of the electrical connection circuit 24, the electromagnetic actuator assembly 2 is configured to energize the first coil 21 without energizing the second coil 22 in the first operating mode of the actuator assembly 2. Further, the electromagnetic actuator assembly 2, by means of the electrical connection circuit 24, is configured to energize both the first coil 21 and the second coil 22 in the second operating mode of the actuator 2.

More specifically, the electrical connection circuit 24 has a first external electrical connection 241, a second external electrical connection 242 and a diode 243. The first coil 21 and the second coil 22 are connected in series between the first external electrical connection 241 and the second external electrical connection 242. The second coil 22 is connected in parallel with the diode 243. The diode 243 is directed in such fashion that it reduces the current flow through the second coil 22—in particular that it short-circuits the second coil 22—in the first operating mode. In this way, the actuator assembly 2 is switchable between the first operation mode and the second operation mode in simple fashion.

Figure 2A:
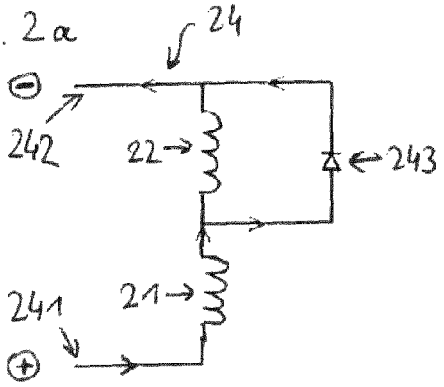
FIG. 2*a* shows an electric circuit diagram of the electromagnetic actuator assembly according to the first embodiment in a first operating mode.
Figure 2B:
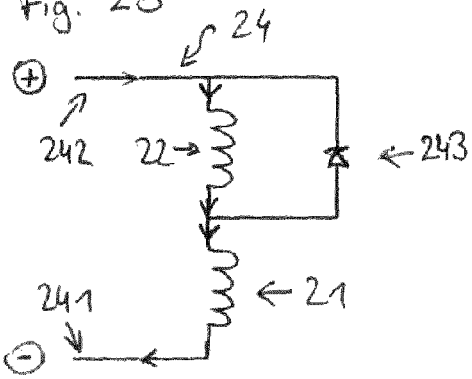
FIG. 2*b* shows an electric circuit diagram of the electromagnetic actuator assembly according to the first embodiment in a second operating mode.

FIGS. 2*a* and 2*b* show electric circuit diagrams of the actuator assembly 2 of the first embodiment in the first operation mode (FIG. 2*a*) and in the second operation mode (FIG. 2*b*). The respective current flow is indicated by arrows in FIGS. 2*a* and 2*b*.

In the first operation mode (see FIG. 2*a*) an operation current is provided to the electrical connection circuit 24 which operation current flows from the first external electrical connection 241 to the second external electrical connection 242, as indicated by the plus and minus signs in FIG. 2*a*. Expediently, the operation current is a DC current or has at least a DC portion.

The current flows from the first external electrical connection 241 through the first coil 21. Since the diode 243 is operated in forward direction in the first operation mode, it short-circuits the second coil 22 to which it is connected in parallel. Therefore, the operation current in the first operating mode flows basically completely through the diode 243—and not through the second coil 22—to the second external electrical connection 242. In this way, the first coil 21 is energized without energizing the second coil 22 in the first operating mode.

In the second operating mode (see FIG. 2*b*), the current direction of the operating current is reversed. Thus, the current flows from the second external electrical connection 242 to the first external electrical connection 241, as indicated by the plus and minus signs in FIG. 2*b*. In this case, the diode 243 is operated in the reverse direction so that its blocks the operation current. Therefore, in the second operating mode, the operating current flows through the second coil 22 and through the first coil 21, so that both the first and second coils 21, 22 are energized in the second operating mode.

Figure 3:
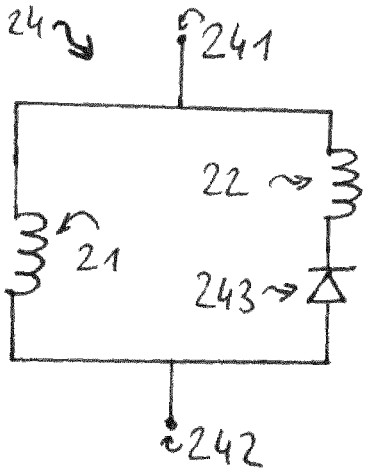
FIG. 3 shows an electric circuit diagram of an electromagnetic actuator assembly according to a second embodiment.

FIG. 3 shows an electric circuit diagram of an electromagnetic actuator assembly 2 according to a second embodiment.

The actuator assembly 2 according to the second embodiment has an electrical connection circuit 24 which is different from that of the first embodiment. According to the second embodiment, the second coil 22 and the diode 243 are connected in series. The first coil 21 is connected in parallel thereto.

When the DC operating current flows from the first external electrical connection 241 to the second external electrical connection 242, i.e. when the actuator assembly 2 is in the first operating mode, the diode 243 is operated in reverse direction and blocks current flow through the second coil 22. In the second operating mode, having the current direction reversed, the diode 243 is operated in forward direction and the operation current flows through both the first and second coils 21, 22.

Although—in both embodiments—the magnetic field of the first coil 21 in the first operating mode and is directed in the opposite direction to the magnetic field of the first and second coils 21, 22 in the second operating mode due to the reversed current direction, the magnetic force on the armature 23 is exerted in the same direction—towards the pole piece 26—in both operating modes. The armature 23 preferably comprises a soft magnetic material with a small reminiscent magnetic field, so that the risk of losses in magnetic force and/or response time due to switching of the magnetic field direction is particularly low.

In the first operating mode, a particularly small closing time may be achievable with the actuator assembly 2 according to the present embodiments, in particular since only the impedance of the first coil 21 is relevant in this case. The closing time is in particular the time difference between the time when the operation current through the actuator assembly 2 is deactivated and the time when the valve needle 11 reaches the closing position. In the first operating mode, the closing time may be 250 μs or less, preferably 200 μs or less. In one development, the closing time is 50 μs or more.

In the second operating mode, the fluid injection valve may be able to open at particularly high fluid pressures, in particular since the inductances of the first and second coils 21, 22 add to each other so that a higher magnetic field is achievable than with the first coil 21 alone. For example the fluid injection valve 1 may be operable to open at fluid pressures of 200 bar or more, e.g. at fluid pressures between 200 bar and 500 bar. In a variant, the fluid injection valve may be suitable for use in a diesel engine and may be operable to open at fluid pressures of 2000 bar or more.

The closing time may be larger in the second operating mode than in the first operating mode. For example, it has a value of 400 μs or more. In one embodiment, the closing time in the second operating mode may be in the range of 800 μs.

Figure 4:
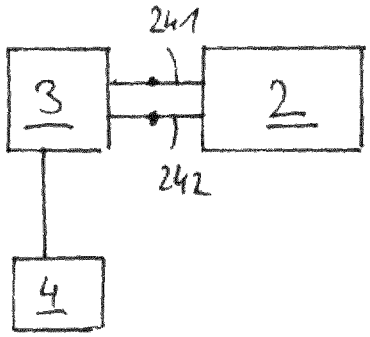
FIG. 4 shows a schematic representation of a fluid injection assembly comprising the electromagnetic actuator assembly of the first embodiment and a power supply.

FIG. 4 shows a schematic representation of a fuel injection assembly comprising the electromagnetic actuator assembly 2 according to the first embodiment—in particular it comprises the fluid injection valve 1 according to the first embodiment—and a power supply. The power supply, in the present embodiment, is an engine control unit 3.

The first and second external electrical connections 241, 242 are connected to the engine control unit 3. The engine control unit 3 may be operable to provide an operating current to the electrical connection circuit 24 via the first and second external electrical connections 241, 242. The operating current may be a DC current or may at least have a DC portion.

Expediently, the engine control unit 3 is operable to switch the actuator assembly 2 between the first and second operation modes by reversing the current direction of the operating current or its DC portion. In particular, the engine control unit 3 is operable to determine a fluid quantity which is to be dispensed by the fluid injection valve 1, to compare the determined fluid quantity with a predetermined threshold and to select the first or second operating mode, respectively, for the fluid injection valve 1 depending on the result of the comparison between the determined fluid quantity and the predetermined threshold. Expediently, the engine control unit 3 selects the first operating mode when the determined fluid quantity is smaller than the threshold and the second operating mode when the determined fluid quantity exceeds the threshold.

In another embodiment, the engine control unit 3 is operable to determine a fluid pressure of the fluid which is to be dispensed by the fluid injection valve 1, to compare the determined fluid pressure with a predetermined threshold and to select the first or second operating mode, respectively, for the fluid injection valve 1 depending on the result of the comparison between the determined fluid pressure and the predetermined threshold.

In one development, the fluid injection valve 1 is hydraulically connected to a fluid rail comprising a high pressure pump 4. Such fluid rails are, in principle, known to the person skilled in the art and, therefore, are not described here in further detail.

The engine control unit 3 may additionally or alternatively be operable to control the high pressure pump 4 (see FIG. 4). Preferably, the engine control unit 3 is configured to set a first pressure for the high pressure pump 4, when the actuator assembly 2 is operated in the first operation mode, and to set a second pressure for the high pressure pump 4, when the actuator assembly 2 is operated in the second operation mode, the second pressure being greater than the first pressure.

The invention is not limited to specific embodiments by the description on basis of these exemplary embodiments. Rather, it comprises any combination of elements of different embodiments. Moreover, the invention comprises any combination of claims and any combination of features disclosed by the claims.

The invention claimed is:

1. An electromagnetic actuator assembly for a fluid injection valve comprising:

a first coil and a second coil concentrically mounted in a housing and configured to move an armature, an electrical connection circuit configured to connect the first and second coils to a power supply, and a first external electrical connection and a second external electrical connection configured to connect the electrical connection circuit to the power supply, wherein the actuator assembly is switchable between:

a first operating mode in which a direct current flows from the first to the second external electrical connection, and a second operating mode in which a direct current flows from the second to the first external electrical connection, and wherein the electrical connection circuit is configured to:

energize the first coil without energizing the second coil in the first operating mode of the actuator assembly, and energize both the first coil and the second coil in the second operating mode of the actuator assembly.

2. The electromagnetic actuator assembly of claim 1, wherein the electrical connection circuit comprises a switching component configured to reduce a current flow through the second coil or for short-circuiting the second coil when the actuator assembly is in the first operating mode.

3. The electromagnetic actuator assembly of claim 2, wherein the switching component comprises a diode.

4. The electromagnetic actuator assembly of claim 2, wherein either:

the first coil and the second coil are electrically connected in series by the electrical connection circuit, and the switching component is electrically connected in parallel to the second coil, or the second coil and the switching component are electrically connected in series and, together, are electrically connected in parallel to the first coil.

5. A method for operating a fluid injection valve including a valve needles closing an injection nozzle in a closing position, an armature mechanically coupled to the valve needle, an electromagnetic actuator assembly having a first coil and a second coil configured to move the armature and thereby move the valve needle away from the closing position for dispensing a fluid, and an electrical connection circuit connecting the first and second coils to a power supply, and a first external electrical connection and a second external electrical connection connecting the electrical connection circuit to the power supply, wherein the electrical connection circuit energizes the first coil without energizing the second coil when a direct current flows from the first external connection to the second external connection and energizes both the first coil and the second coil when a direct current flows from the second external electrical connection to the first external electrical connection, the method comprising:

determining a property of a fluid to be dispensed by the fluid injection valve, comparing the determined fluid property with a predetermined threshold, based on the results of the comparison, switching an operation of the fluid injection valve between a first operating mode and a second operating mode to generate a magnetic force on the armature and thereby move the valve to dispense the fluid from the fluid injection valve, wherein switching the operating mode comprises:

when the determined fluid property is smaller than the predetermined threshold according to the comparison, operating the fluid injection valve in the first operating mode by feeding the operating current to the electrical connection circuit via the first and second external electrical connections such that the operating current flows from the first to the second external electrical connection to generate the magnetic force on the armature solely using the first coil, and when the determined fluid property is larger than the predetermined threshold according to the comparison, operating the fluid injection valve in the second operating mode by feeding the operating current to the electrical connection circuit via the first and second external electrical connections such that the operating current flows from the second to the first external electrical connection to generate the magnetic force on the armature using both the first coil and the second coil.

6. The method of claim 5, wherein the determined fluid property is a fluid quantity to be dispensed by the fluid injection valve or a fluid pressure.

7. A fluid injection valve, comprising:

an armature;

a valve needle mechanically coupled to the armature; and an electromagnetic actuator assembly comprising:

a first coil and a second coil concentrically mounted in a housing and configured to move the armature to thereby move the valve needle, an electrical connection circuit configured to connects the first and second coils to a power supply, and a first external electrical connection and a second external electrical connection that are configured to connect the electrical connection circuit to the power supply, wherein the actuator assembly is switchable between:

a first operating mode in which a direct current flows from the first to the second external electrical connection, and a second operating mode in which a direct current flows from the second to the first external electrical connection, and wherein the electrical connection circuit is configured to:

energize the first coil without energizing the second coil in the first operating mode of the actuator assembly, and energize both the first coil and the second coil in the second operating mode of the actuator assembly.

8. The fluid injection valve of claim 7, wherein the electrical connection circuit of the electromagnetic actuator assembly comprises a switching component configured to reduce a current flow through the second coil or for short-circuiting the second coil when the actuator assembly is in the first operating mode.

9. The fluid injection valve of claim 8, wherein the switching component comprises a diode.

10. The fluid injection valve of claim 8, wherein either:

the first coil and the second coil are electrically connected in series by the electrical connection circuit, and the switching component is electrically connected in parallel to the second coil, or the second coil and the switching component are electrically connected in series and, together, are electrically connected in parallel to the first coil.

* * * * *